United States Patent [19]

Norris

[11] 4,019,680

[45] Apr. 26, 1977

[54] STEAM GENERATING SYSTEM INCLUDING MEANS FOR REINITIATING THE OPERATION OF A STEAM BOUND BOILER FEED PUMP

[76] Inventor: Orlin R. Norris, 36 Reservoir Road, Parsippany, N.J. 07054

[22] Filed: Nov. 24, 1975

[21] Appl. No.: 634,817

Related U.S. Application Data

[63] Continuation-in-part of Ser. No. 512,498, Oct. 7, 1974, Pat. No. 3,940,058.

[52] U.S. Cl. ..... 237/9 R; 417/199 A

[51] Int. Cl.[2] ..... F24D 1/02

[58] Field of Search ..... 237/9 R, 12.8, 67; 415/116, 1; 122/451; 60/667, 688, 689, 692; 417/199 A, 435

[56] References Cited

UNITED STATES PATENTS

| | | | |
|---|---|---|---|
| 1,971,441 | 8/1934 | Broadhurst | 417/200 X |
| 2,871,700 | 2/1959 | Hilkene | 73/328 |
| 3,126,875 | 3/1964 | Vogler | 122/451 R |
| 3,493,175 | 2/1970 | Fogarty et al. | 237/9 R |
| 3,940,058 | 2/1976 | Norris | 237/9 R |

*Primary Examiner*—William E. Wayner
*Assistant Examiner*—William E. Tapolcai, Jr.
*Attorney, Agent, or Firm*—Behr & Woodbridge

[57] ABSTRACT

An improved steam boiler system includes an automatic means for injecting cool water into a steam bound boiler feed pump. In a first embodiment a pressure sensitive check valve detects the drop of pressure in the steam bound pump and in response thereto directs a cool water mist into the high side of the pump, thus reinitiating its operation. According to a second embodiment, cool water is sprayed into the pump in response to a drop of the water level in the boiler. In both embodiments, a vent line is used to bleed the high side of the centrifugal pump to a condensate tank in response to a drop of pressure in the pump. The vent line may be bled through a check valve or directly through a manual valve. Additionally, both embodiments employ a pressure sensitive valve in the boiler feed line, which shuts off the pump flow to the boiler whenever the pressure in the boiler exceeds the pressure at the output of the pump. The invention has the major advantage of reinitiating the operation of a steam bound boiler feed pump but has as an important secondary advantage the ability to keep the pump packing seals under liquid pressure, thereby preventing the packing from burning up in the event that the pump becomes steam bound.

9 Claims, 3 Drawing Figures

STEAM GENERATING SYSTEM INCLUDING MEANS FOR REINITIATING THE OPERATION OF A STEAM BOUND BOILER FEED PUMP

CROSS-REFERENCES TO RELATED APPLICATIONS

This application is a continuation-in-part of my copending application entitled "Improved Steam Generating System Including Means For Reinitiating The Operation Of A Steam Bound Boiler Feed Pump," Ser. No. 512,498, Filed Oct. 7, 1974 now Pat. No. 3,940,058. The descriptions in said copending application are hereby incorporated by reference.

BACKGROUND OF THE INVENTION

1. Field of the Invention

This invention relates to steam generating systems in general and more specifically to a system for automatically injecting a cool water mist into a steam bound boiler feed pump.

2. Background of the Invention

In a typical steam generator, a hot water boiler is fed by a centrifugal boiler feed pump. For a variety of reasons it is not unusual for such pumps to become "steam bound" and when this occurs, the efficiency of the boiler pump drops considerably. During the course of disclosure, the term steam bound will be used interchangeably with the term "air bound" as those two terms are understood to imply essentially the same undesirable condition. To overcome this condition, the steam plant operator often has to cool down the steam bound pump by applying cold water to its exterior housing. Several other approaches are discussed in the prior art. For example, Vogler U.S. Pat. No. 3,126,875 discloses injecting cold water into the intake side of a water pump in order to eliminate vapor lock therein. The cold water is injected into the pump in response to a pressure differential measuring device which monitors the pressure in a hot water tank. Similarly, British Pat. No. 343,385 discloses injecting a second liquid into a centrifugal pump and calls for the liquid to be under pressure and to enter the pump through a plurality of nozzels located in the housing. Other prior art references of relevance include: Hariveau U.S. Pat. No. 1,581,204; Hutton U.S. Pat. No. 3,286,639; Jackson U.S. Pat. No. 3,504,986; German Pat. Nos. 304,763; 475,711; and 556,579; and British Pat. No. 308,442.

Unfortunately, the techniques disclosed by the prior art are often complicated, both in structure and function. Since the problem of steam bound boiler feed pumps in common, a direct and straight-forward solution to this problem was sought. Additionally, the problem of steam bound pumps is frequently associated with low water boiler failures. For example, a total of 44 accidents occurred due to low water failures in power boilers during the period of Jan. 1, 1973 through Dec. 31, 1973 as reported by the National Board of Boiler and Pressure Vessel Inspectors. Those accidents resulted in four known injuries. Similarly, low water failures resulted in 78 accidents in heating boilers during the same period. These statistics only reflect reported insurance accidents and do not take into account factors such as lost production time and boiler damage repair cost. For example, if the boiler tubes burn out they must be replaced and the plant must be shut down during the replacement period. While not all low water failures are attributable to malfunctioning feed pumps, nevertheless, malfunctioning pumps are believed to be a significant factor in such difficulties. Therefore a means was sought which would prevent low water boiler failures due to steam bound pumps. This, of course, would increase the safety of steam generators and generally improve reliability. The factor of reliability is very important, since it is often necessary to have a complete steam generator system in standby condition ready for operation if the use of steam is critical. For example, a naval man of war in the attack condition; a petroleum oil cracking tower or a hospital must be able to maintain steam power under all conditions. By automatically eliminating the steam bound pump condition, it may be possible to eliminate the necessity of a secondary system in such steam generating operations. Therefore, from the safety and reliability point of view, the ability to automatically clear a steam bound boiler pump is a very important capability. It is believed that the present invention has applicability to a wide range of prior art steam generators, including stationary, marine, locomotive and portable boilers. Also, while a centrifugal pump is used as an illustrative example, it is to be understood that this system may be applied to many other pumps known in the prior art. It was in the context of the foregoing prior art that a simple, safe, efficient and reliable means was sought to solve the problem of steam bound boiler feed pumps.

Another problem frequently associated with steam bound or air bound pumps is the difficulty of keeping the packing seals lubricated when the pump goes into a steam bound condition. Many prior art pumps are equipped with liquid lubricated packing seals which require a continual application of water in order to keep them adequately lubricated. In the steam bound condition these seals will frequently dry out and burn up. When a seal burns up it may require that the boiler system be turned off until such time as the liquid lubricated packing seals can be replaced.

Several different types of packing seals are known to those of ordinary skill in the art. Some are of the passive variety and others include features for improving the circulation of the lubricating liquid. An example of a circulating seal is the Dura circulating seal, Type P.T., manufactured by the Dura Metallic Corporation of Kalamazoo, Mich. One of the advantages of using such circulating seals is that it reduces the possibility of steam flashing, and thereby protects the seal from running "dry".

One technique to prevent lubricating seals from running dry is to provide a special bypass channel from the high side of a pump to the packing seals. A controllable valve is often located in that channel. Therefore, the amount of lubrication to the seal can be controlled. This approach is disclosed in a publication entitled "Pump Maintenance" published by the Allis-Chalmers Manufacturing Company of Milwaukee, Wisc. During the course of operation, it is generally necessary for a boiler maintenance engineer to provide lubrication to a "steam bound pump" as soon as possible so as to avoid the problem of burning the packing seals. The present invention includes a method of insuring that such packing seals do not run dry and therefore it helps to overcome the prior art problem of having the packing seals burn when the pump is in the steam bound condition.

SUMMARY OF THE INVENTION

A typical steam generating system generally includes at least: a steam boiler; a boiler feed line; a boiler pump; a pump suction line; a condensate receiver tank; and a heat radiating system connecting the boiler to the condensate tank. As discussed previously, the problem of steam bound boiler feed pumps contributes to the danger and inefficiency of prior art systems. To solve these problems, a means is added to a conventional steam generating system that automatically reinitiates the operation of a steam bound boiler feed pump. According to one embodiment, the pump includes a plurality of cold water inlet pipes controlled by a pressure sensitive check valve. The valve serves to spray the high pressure side of the pump when the pressure drop therein signals a steam bound condition. At the same time, a pressure sensitive weighted check valve opens to allow steam to return to the reservoir. This allows the steam trapped in the high side of the pump to escape, thereby allowing the pump to clear. According to a second embodiment, the steam bound pump is injected with a cold water spray in response to a predetermined low water level in the boiler. However, in the second embodiment, the weighted check valve will open and vent the steam at a point in time prior to injecting the cold water spray. Both embodiments include the vent pipe feature which bleeds the high pressure side of the pump to the condensate tank. In both cases the vent line may be bled, either through a check valve or through a manual valve. Additionally, both embodiments include a check valve feature in the boiler feed line which isolates the boiler from the steam bound pump.

Another important feature of the present invention is that it automatically provides for the lubrication of the packing seals of a steam bound boiler pump. This advantage may come about directly or indirectly through the fact that when the high side of the steam bound pump is washed with cool water, that cool water will find its way to the packing seals and prevent them from burning up. Alternatively, this feature can be added to pumps that are not already equipped to directly lubricate their seals by the judicious placement of a cool water input line near the seal region thereof.

Other advantages of the present invention will be more clearly understood in reference to the following drawings.

IN THE DRAWINGS

DETAILED DESCRIPTION OF THE EMBODIMENTS

During the course of this description, like numerals will be used to refer to like elements in the different drawings.

Figure 1:
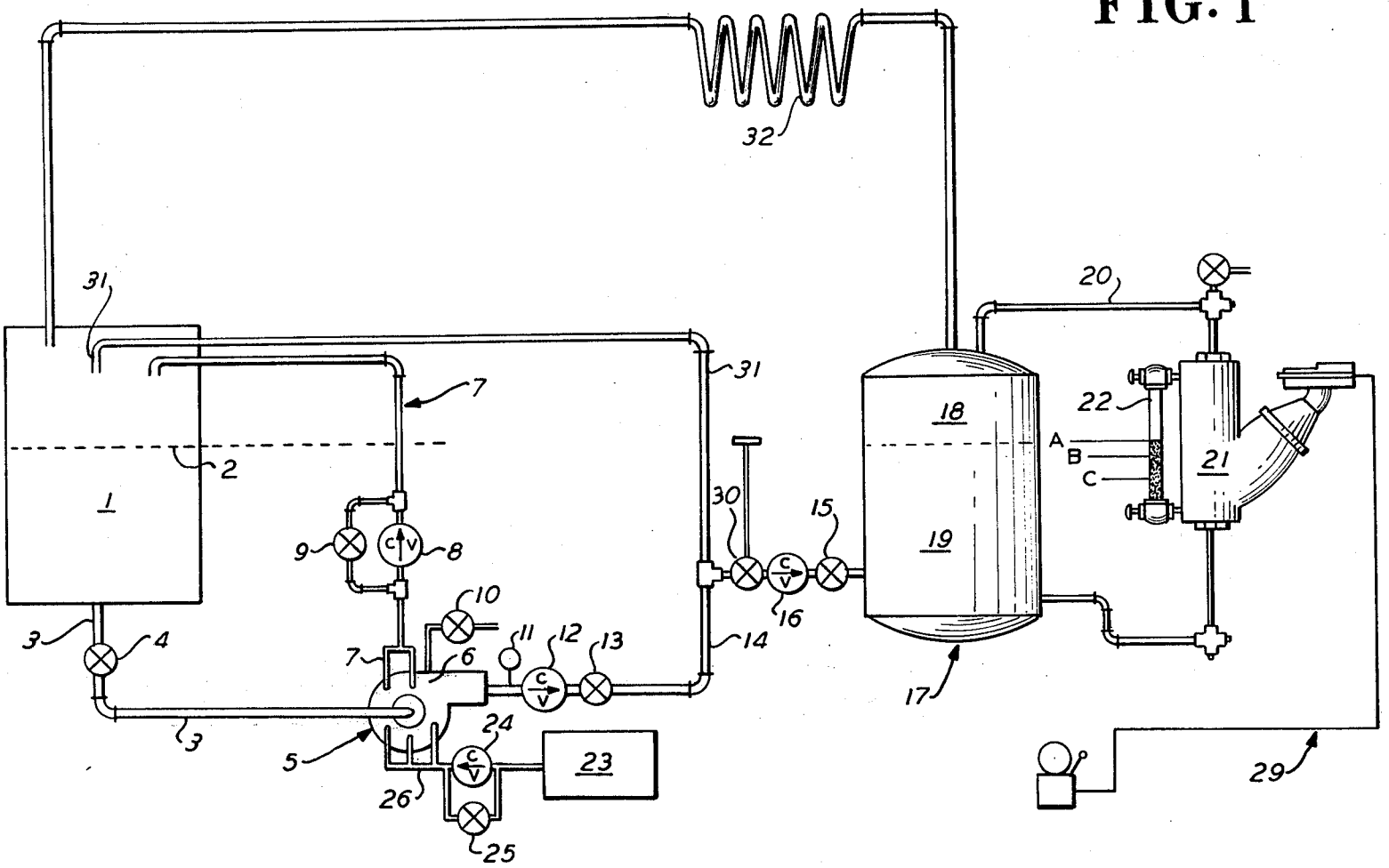
FIG. 1 is a schematic diagram of the present invention in which the cool water injection to the steam bound pump is controlled by a check valve.

A water feeder type of steam generating system is schematically described in FIG. 1. According to one embodiment of the present invention, the water feeder system includes the following basic components:

A condensate tank 1; a suction line 3; a centrifugal boiler feed pump 5; a boiler feed line 14; a boiler or steam generator 17; and a heat radiating system 32, which returns the steam from the boiler 17 to the condensate tank 1.

The water level in the condensate tank 1 is numerically shown as 2 and this defines the boundry between the liquid and air phase of the reservoir. In a typical operation, the temperature of the condensate tank is approximately 180° F. This higher temperature is desirable because it increases the overall efficiency of the system due to lower heat loss. In the context of a steam generating plant it would be desirable to raise the reservoir temperature to 180° F or more in order to increase efficiency. Unfortunately, a steam plant operator has so many other duties that it is difficult for him to maintain such a high temperature. The reservoir temperature cannot be kept at a higher temperature without constant monitoring of the generating equipment since at elevated temperatures, such as 180° F, the water is more likely to flush into steam in the pump. However, if the self clearing system of the present invention is employed, the condensate tank temperature can safely be raised up to 180° F or above without additional supervision. It is estimated that for each 11° F increase in boiler waste or recovered and/or used steam or stack heat there is a 1% increase in overall plant efficiency. Therefore, an increase of from 140° to 180° F can improve plant efficiency by about 3.6%.

The liquid phase of condensate tank 1 is connected via suction line 3 to the low pressure side of centrifugal pump 5. A manual valve 4 in suction line 3 serves to control the flow into the pump. Valve 4 can be used to isolate the pump for purposes of repair.

Centrifugal pump 5 includes a plurality of ports 6 located around the high side or outside periphery of the pump housing. Several of the peripheral holes 6 are connected by a vent line 7 to the air phase of condensate tank 1. Vent line 7 represents a collection of ¼ inch o.d. tubes which serve to bleed the steam in a steam bound pump 5 back to condensate tank 1. The steam or vapor from the pump is automatically bled through a check valve 8. Check valve 8 might typically be a spring loaded or weighted type of check valve. A bypass test valve 9 runs in parallel with check valve 8 and provides a manual control over line 7. Valve 8 may also be used to test the condition of the high side of the pump. If pump 5 becomes steam bound, the pressure at port 6 will drop. When this is the case, the weighted check valve 8 opens and allows the pump to automatically bleed the steam away from the housing and back to the condensate receiver. This has several advantages. One advantage is that the operation of the pump may be cleared automatically if the steam phase within the pump can be bled back to the reservoir or to atmosphere. Another advantage is that the reservoir can collect the hot water which otherwise would be wasted and spilled on the floor. In typical prior art applications, a special bleed valve 10 and line might be installed in the pump and this is used to manually bleed the pump. However, by using an automatic check valve in a vent line to the condensate tank, this operation becomes automatic with no loss of water and no danger to the operator of the equipment. In short, the pump automatically clears itself when it becomes steam bound. The hole 6 in the periphery of the housing are often made during the pump manufacturing process for the purpose of placing test valves, gauges, bleeder lines and the like on the high pressure side. Alternatively, of course, holes or ports 6 may be specially drilled into the high pressure side of the pump in order to provide access thereto.

Boiler feed line 14 includes a pump pressure gauge 11, pump check valve 12, manual pump valve 13, manual boiler valve 15 and boiler check valve 16. Pump check valve 12 is typically a flap type valve and serves to shut off the flow in line 14 whenever the steam pressure in boiler 17 exceeds the output pressure of boiler feed pump 5. Check valve 16 also performs the same function. The operation of pump check valves 12 and 16 is very important in that when the pump 5 becomes steam bound they prevent the water from the boiler from backing up into the pump and also cause the vapor pressure build up in the pump to be vented through vent line 7 into the condensate tank 1.

Boiler 17 includes a liquid phase 19 and a steam phase 18. An equalizer pipe 20 connects the boiler 17 to a water level gauge 22 and water level detector 21. The function of water control 21 in FIG. 1 is to turn off the boiler heating mechanism if the level of the water in the boiler drops to a dangerously low level. In that regard, three water levels indicated as A, B, C on gauge 22 are of importance.

Level A is the level at which water is to be maintained in generator 17 at all times. If the firing cycle begins the level of water 19 will drop below level A. This causes a known mechanism to introduce make up water into generator 17 through valve 30. The mechanisms used to activate valve 30 are well known to those of ordinary skill in the art. The foregoing class of operation is knows as a feeder type system. The level B may be connected to a pre low water alarm, however, the use of such an alarm is not absolutely necessary in the invention of FIG. 1.

Figure 2:
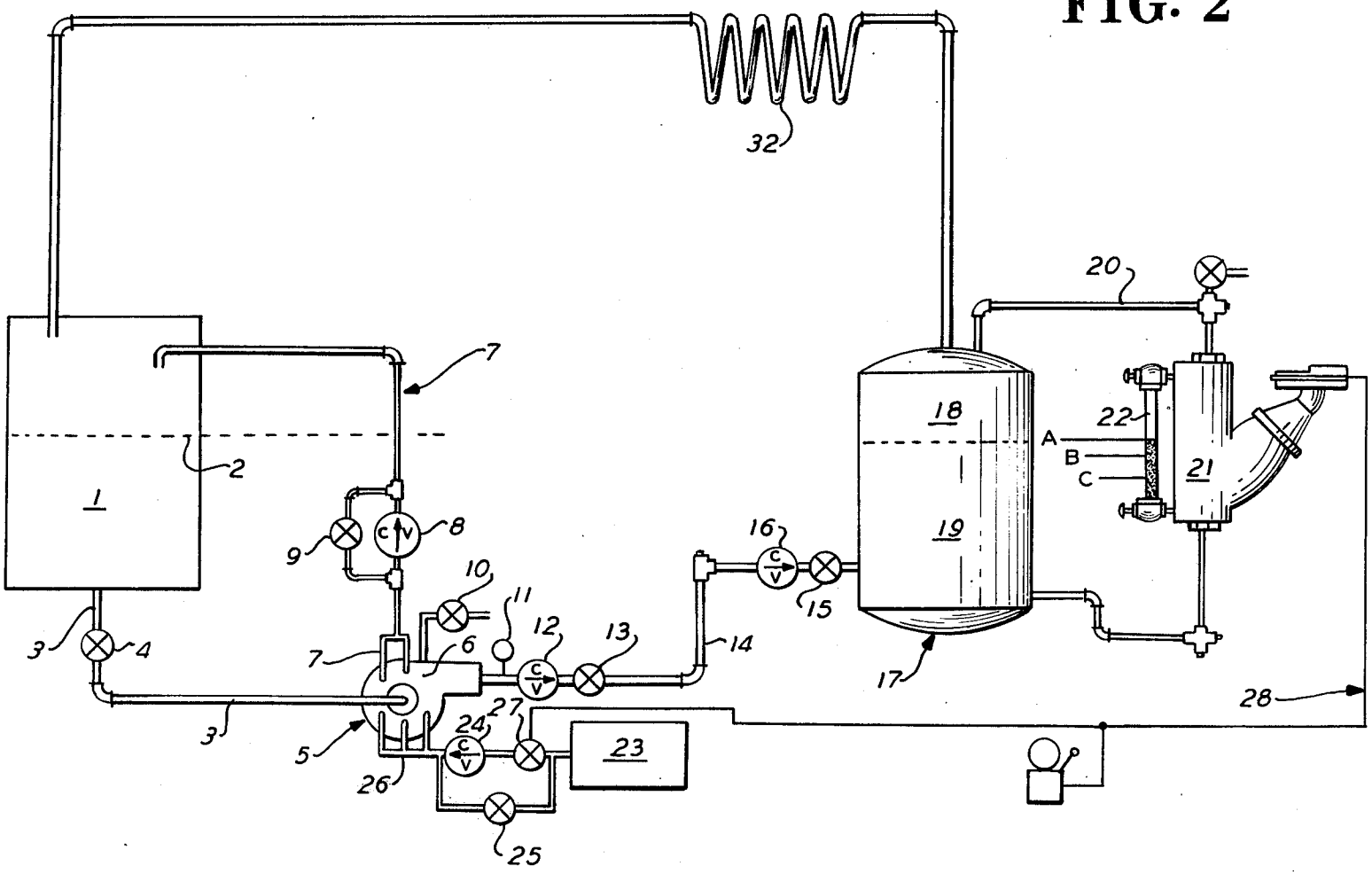
FIG. 2 is a schematic diagram of another embodiment of the present invention in which the cool water injection is controlled by a demand on/off boiler water level detector; and, FIG. 3 is a cross-sectional view of a boiler feed pump illustrating the manner in which the packing seals may be lubricated automatically according to the teachings of the present invention.

Level C is the level at which the controller 21 causes the boiler heater mechanism to turn off the heat to the boiler because the level of the water in the boiler is becoming dangerously low. Additionally, a low water alarm may be used in conjunction with Level C to signal the steam generator operator that the boiler has reached a critical stage. The specific types of water controller 21 will be discussed in more detail with reference to the demans on/off type of embodiment of this invention (FIG. 2).

An additional feature incorporated into this particular embodiment is the automatic cool water mist injecting means 23–26. The means includes a source of high pressure cool water 23 which is connected through pressure sensitive check valve 24 to a plurality of cool water input feed lines 26 connected to periphery ports 6 in the housing of boiler feed pump 5. While a plurality of cool water input feed lines 26 is disclosed as the preferred mode of carrying out the present invention, it is understood by those of ordinary skill in the art that a fortiori a single input line could be employed also. However, the use of a single input line may be undesirable since its ability to quickly cool down the steam bound pump is less than through the use of a plurality of input lines and additionally the chance of damage due the thermal shock may be increased by concentrating a large amount of cool water in a small place rather than spreading smaller amounts of cool water judiciously around the high side of the pump. A manually operated bypass valve 25 is connected in parallel with check valve 24 in the same manner that bypass valve 9 is connected in parallel with check valve 8. Both bypass valves 9 and 25 may be of the globe type variety and can be manually operated in order to bypass the functions of check valves 8 and 24 respectively. In operation, when the pump 5 becomes steam bound the high side of the pump loses pressure and therefore the check valve 24 opens up to inject a cool mist of spray into the steam bound section of the pump from cool water source 23. The mist is typically injected in the form of a spray so as to reduce the possible danger from thermal shock. This is important because thermal shock can seriously damage the interior components of pump 5.

In normal operation, the pump 5 feeds condensate water from tank 1 into boiler 17 via suction line 3 and boiler feed line 14. In the course of operation, the pump is continuously pumping water. The flow of water from the pump 5 into the generator 17 is controlled by valve 30. Valve 30 opens up in proportion to the demand of the feeder mechanism. If the generator needs water then valve 30 opens up, but if it does not need water valve 30 closes and more excess water is returned to condensate tank by line 31. The water continuously cycles from pump 5 back to condensate tank 1 until valve 30 opens up. Therefore, it is clear that in the feeder type operation valve 30 feeds the generator in response to the need of the boiler. If, during the course of operation, the temperature of the water in the centrifugal pump 5 increases to the point where the pressure and volume of that water cause it to flash into steam, then the pump becomes steam bound and can no longer pump water into the boiler 17. When the pump becomes steam bound, several things occur. Immediately, due to the relatively higher boiler pressure, the check valve 16 will close, thereby preventing any flow of fluid into boiler 17. At the same time, check valve 8 will open up causing the trapped steam in the high pressure side of the pump 5 to be bled into the air phase of condensate tank 1 via vent line 7. Additionally, cool water will be sprayed into the pump from cool water source 23 via check valve 24 and inlet lines 26. This serves to cool down the pump and automatically reinitiate its operation. The steam generated by the cool water is automatically removed via line 7. The advantages of this procedure are that it immediately responds to the steam bound condition in the pump as opposed to responding to a condition outside of the pump. This greatly decreaes any time lag and greatly increases the safety factor associated with low water level failures. If, however, the water in the boiler should reach the critical Level C, then water controller 21 will automatically turn off the heat supply to boiler 17.

While Levels A and C are very important to the functioning of the system, an intermediate Level B can be added for extra protection. Level B would preferably be a pre low water alarm which can warn the steam generator operator of functional problems prior to automatic shut off of the boiler at Level C.

It will be noted that the approach taken by this particular embodiment differs from methods such as those disclosed in the Vogler patent in that such prior art approaches depend upon conditions external to the pump to cause the pump to be cooled down with water. In contrast thereto, this particular arrangement allows the pump to be immediately quenched with a cool water mist in response to the internal condition of the pump rather than in response to the external indicators in other parts of the system.

Another embodiment of the present invention is disclosed in detail with reference to FIG. 2 wherein elements with like numbers will refer to the same elements as discussed with regard to FIG. 1. FIG. 2 discloses a demand on/off type of system in which the cooling of the pump 5 is controlled by the operation of the water level control 21. According to this embodiment, cool water sprayed into the high pressure side of pump 5 is controlled by a solenoid valve 27 which, in turn, is responsive to controller 21. Again, while a plurality of cool water input lines 26 is specifically disclosed as a preferred second embodiment of the invention, it is clear to those of ordinary skill in the art that a single cool water input line could be used also though this approach is not as desirable as using a plurality of cool water input lines. Check valve 24 serves to protect solenoid valve 27 from high pressures. According to the embodiment of FIG. 2, Level A indicates the level at which the controller 21 causes pump 5 to turn off and stop feeding water to the boiler. Level B is that level which causes pump 5 to begin operation and to feed water into the boiler. Level C is the same heating system shut off level as described with reference to FIG. 1. The solenoid valve can be turned on at either Level B or Level C. This particular type of embodiment has the advantage in that it allows a time lag to take place between the time that check valve 8 opens and bleeds steam to condensate tank 1, via line 7 and the time that the pump 5 is quenched by cool water from cool water source 23. Since the water level control 21 is an important part of this embodiment, a discussion of the different types of suitable water level controls is desirable.

In general, there are three different types of prior art water level controls. There is a float-magnet type of control in which a ferrous plunger controls the on/off activity of a mercury type switch. A second type of low water control is known as the float-linkage type in which a float connected to a lever will determine whether or not a mercury switch opens or closes a burner or pump circuit. Typical of the float-linkage type of level control is the McDonnel and Miller high pressure control model Numbers 150 or 150-M. This particular model includes two mercury switches, one of which is connected to a low water alarm circuit. In the feeder type system of FIG. 1, only one switch is necessary for use with the low water alarm circuit. A second switch is not required. However, a second switch can optionally be used as a pre low water alarm if so desired. In the second embodiment one switch is used as a low water alarm and the other switch is used to meet the water demand of the steam generator. Finally, a third type of conventional water level cutoff device is the electrode probe type. Typical of this mechanism is the model 4L Powermasters which includes a plurality of electrodes which correspond to the Levels A, B, C previously described with reference to controller 21. Obviously, from the foregoing, it is clear that a wide variety of conventional water level detectors can be used in conjunction with the invention herein described.

In typical operation of the demand on/off type of system, the pump 5 again feeds water to the boiler 17 according to the command of level detector 21. If the pump becomes steam bound, then check valve 12 closes and check valve 8 opens up to bleed some of the steam trapped within pump 5 back to condensate tank 1. Hopefully, the bleeding of the steam through vent line 7 will be sufficient to reinitiate the operation of the steam bound pump 5. However, if this does not occur, then the water level in boiler 17 will continue to drop until such point that the water level control 21 will cause solenoid valve 27 to open and to flush the steam bound interior of pump 5 with cold water from source 23. As discussed before, the operation of solenoid valve 27 can be initiated at either Level C or Level B. Check valve 24 protects solenoid valve 27 from the high pressure of the pump during normal operation. Moreover, the operation could be initiated in any arbitrary level if a third mercury switch is added to the appropriate type of water level control. The important point is that the pump is not flushed with cool water immediately after becoming steam bound, but is only flushed with water after the bleed line 7 has had a chance to try to clear the pump. If the bleeding of steam from the pump via line 7 does not do the trick, then the cooling of the pump by the cool water injection method should be sufficient to reinitiate pump operation.

While the invention has been described in terms of two embodiments, it will be understood by those of ordinary skill in the art that certain modifications are possible without departing from the spirit of the invention. For example, in both FIGS. 1 and 2, a simplified heating system 32 is illustrated as connecting the boiler 17 to the condensate tank 1. Obviously, a wide variety of steam utilization devices could be employed instead. For example, a steam operated engine or a more complicated and elaborate heat exchanging system would also be suitable in the context of the present invention.

As discussed previously, the cold water vapor mist is injected into the high pressure side of the centrifugal pump. Some of the prior art discusses injecting cool water in the low pressure side but for a variety of reasons this approach is not completely satisfactory. For one reason, it is desirable to inject cold water into the high pressure side of the pump because there is a better mixing of fluids and consequently a faster cooling of the housing and the impellor. Also, many centrifugal pumps already have holes bored in their outer housing in which bypass lines or the like may be installed. It is possible to take advantage of these premade holes for the cool water injection and the steam bleed technique disclosed herein. Of course, additional holes could be drilled in the high pressure side of the outer pump housing if such holes are required. But it should be kept in mind that cool water could be sprayed into the low pressure side of the pump even though that approach is not as satisfactory as supplying the cool water mist to the high side of the pump. Accessability to the interior of the pump is important because it allows the automatic mist injection means to respond automatically to conditions inside the pump as opposed to outside the pump. This is one feature that distinguishes the present invention from other prior art approaches because, in the water feeder type of mechanism disclosed in FIG. 1, the cool water mist is sprayed into the high pressure side of the pump in response to the interior condition of the pump and not the exterior condition.

By spraying the cold water mist directly into the inside of the pump, it is possible to remove a greater number of heat B.T.U.'s from the system than by dousing the outside of the pump with cold water as taught in the prior art. The cold water mist turns to steam when it impinges upon the hot interior and the hot steam is almost immediately removed through check valve 8 and vent line 7. This direct method of heat removal is considered to be a much more efficient and effective means of cooling down a steam bound pump than was known heretofore. Also, this direct method of heat removal is considered to be more effective than cooling down the high side of a steam bound pump with a single individual cool water input line.

The major advantage of the foregoing invention is that a pump in the steam bound condition can automatically correct itself without external, manual control. Also, the system has the secondary advantage of being self-priming. The system is self-priming because the condensate reservoir 1 is above the level of pump 5. Since this is the case, water will always flow into pump 5 whenever there is a need. In many prior art systems, the boiler feed pump has to be manually primed in order to initiate operation. Another advantage of this system is that by bleeding the steam from pump 5 back to the condensate tank 1 via line 7 the system as a whole does not lose any pressure. In contrast to this approach, a common prior art technique has been to bleed the steam from the pump to the atmosphere. This technique can lead to significant losses in pressure. According to the present invention, the more vent lines 7 that can be connected to pump 5 the faster and more efficiently pump 5 can be cleared of steam.

One possible improvement of the invention would be the addition of a constantly open small bleed line to replace line 7 and valves 8 and 9. A constantly open bleed line has the advantage of automatically clearing a steam bound pump but has the disadvantage of lowering effective head pressure. Such an approach is deemed to be much less desirable than the approaches described with reference to FIGS. 1 and 2.

Figure 3:
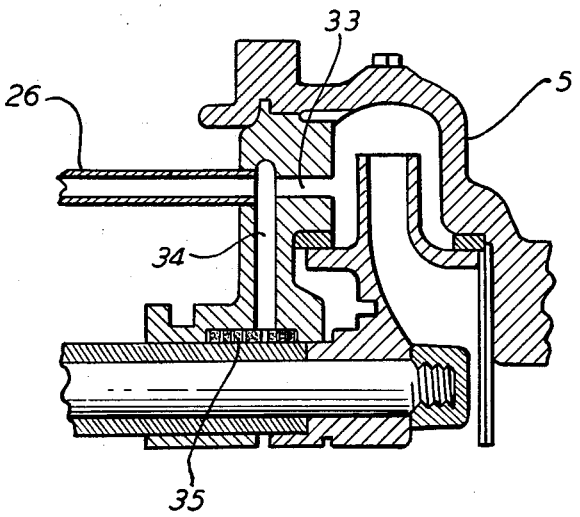

FIG. 3 illustrates an important byproduct feature of the present invention which increases its utility and importance as a means for preventing pumps from reaching the steam bound condition. According to FIG. 3, a boiler feed pump is shown in cross-sectional view. A cool water input line 26 is shown connected to the high side of the pump 5. Cool water input line 26 may comprise one of the cool water input lines or it may comprise the only cool water input line, depending upon the pump employed and the conditions under which it is run. Cool water input line 26 communicates with channels 33 and 34. Channel 33 communicates directly with the high side of the pump and channel 34 communicates directly with packing seal 35. Some pumps are equipped with channels 33 and 34 already precast into their housing. Typically, a valve (not illustrated) would serve to control the flow of liquid between the high side of the pump through channels 33 and 34 to the seals 35. According to the present invention, the valve may be removed and a cool water input line 26 may be inserted directly thereto. In operation, whenever the pump goes into the steam bound condition, the cool water will directly lubricate the seals 35 and simultaneously cool down the high side of the pump. This feature, obviously, can be employed with either of the embodiments of the present invention as illustrated in FIGS. 1 and 2. It is believed that many prior art pumps have other systems in which the packing seals are automatically lubricated either by their close proximity to the high side of the pump or through the use of special channels in the housing. Accordingly, while a direct method of lubricating the seals is illustrated in FIG. 3, it is understood by those of ordinary skill in the art that in many pump embodiments the lubrication of the seals will occur indirectly as a byproduct of cooling down the high side of the pump with cool water.

According to another embodiment of the present invention, it is possible to insert a cool water input line such as 26 but in line 14 between check valves 12 and 16. In the event that the pump becomes steam bound the line 14 would become flushed with cold water. In that case, both check valves 12 and 16 would close thereby forcing up the pressure in pump 5. This in turn would tend to cause the pump to leave its steam bound condition. Alternatively, the check valve 12 could be over ridden or removed so that the cold water in line 14 would back up into the high side of the pump. In such a case, the cold water at the high side of the pump would tend to free the pump of its steam bound condition in the same manner that injecting cool water from the periphery of the pump through a plurality of holes would produce the same results. For the purposes of the invention, the flooding of the high side of the pump 5 through its output port is considered to be the equivalent of spraying the high side of the pump with cool water. This particular possible modification has not been illustrated in the drawings but nevertheless is considered to be one of several different possible modifications of the applicant's basic invention.

While the invention has been particularly shown and described with reference to embodiments thereof, it will be understood by those skilled in the art that various changes in form and detail may be made therein without departing from the spirit and scope of the invention.

I claim:

1. An improved steam boiler system comprising:

a steam boiler including a water level detector for detecting the level of water in said boiler;

a centrifugal pump for pumping water into said boiler, said pump having a low pressure input side and a high pressure output side;

a boiler feed water line connecting said pump to said boiler;

a condensate tank for supplying water to said centrifugal pump;

a suction line connecting said condensate tank to said pump;

a heating system for passing steam from said boiler back to said condensate tank; and, an automatic cool water injection means for injecting water into said pump when said pump is in the steam bound condition, said cool water injection means being responsive to said water level detector.

2. The system of claim 1 wherein said cool water injection means comprises:

a source of cool water;

a cool water input line means connected between said source of cool water and the high side of said pump; and a solenoid valve means responsive to said water level detector and located between said source of cool water and said cool water input line means, wherein said cool water injection means provides cool water to the high side of said pump whenever the level of water in said boiler falls below a certain predetermined level as detected by said water level detector.

3. The system of claim 2 further including:

a vent line connecting the high pressure side of said pump to said condensate tank; and a vent line pressure sensitive valve means located in the path of said vent line, wherein said pressure sensitive valve means opens said vent line whenever the pressure on the high side of said pump falls below a predetermined level.

4. The system of claim 3 further including:

a feed line pressure sensitive valve means located in said feed line and adapted to shut off the flow to said boiler whenever the pressure in said boiler exceeds the pressure at the output of said pump.

5. The system of claim 4 further including:

a bypass valve in parallel with said vent line pressure sensitive valve means.

6. The system of claim 2 wherein said cool water input line means comprises a single cool water input line.

7. The system of claim 2 wherein said cool water input line means comprises a plurality of cool water input lines.

8. The system of claim 2 wherein said pump includes liquid lubricated packing seals and said cool water input line means is connected to said pump in order to lubricate the packing seals directly.

9. An improved steam boiler system comprising:

a steam boiler;

a centrifugal pump for pumping water into said boiler, said pump having a low pressure input side and a high pressure output side;

a boiler feed line connecting said pump to said boiler;

a condensate tank for supplying water to said centrifugal pump;

a suction line connecting said condensate tank to said pump;

a heating system for passing steam from said boiler back to said condensate tank;

a vent line means connected to the high pressure side of said pump; and a pressure sensitive valve means located in said vent line for allowing steam to pass through said vent line whenever the pressure in the high side of said pump falls below a certain predetermined level.

* * * * *